United States Patent [19]

Dyste et al.

[11] 4,165,912

[45] Aug. 28, 1979

[54] OFFSET ADAPTER CONNECTOR

[75] Inventors: Ardell T. Dyste; Raymond Ma, both of Seattle, Wash.

[73] Assignee: Tel-Tone Corporation, Kirkland, Wash.

[21] Appl. No.: 848,822

[22] Filed: Nov. 7, 1977

[51] Int. Cl.[2] ..... H01R 33/94

[52] U.S. Cl. ..... 339/156 T; 339/166 T

[58] Field of Search ..... 339/17 D, 154 R, 154 A, 339/154 L, 153, 155 T, 156 T, 166 T, 166 R, 192 T, 193 R, 193 N, 193 VS, 194 R, 194 N; 361/422, 423

[56] References Cited

U.S. PATENT DOCUMENTS

| | | | |
|---|---|---|---|
| 1,474,763 | 11/1923 | Conlan, Jr. | 339/166 R |
| 1,609,124 | 11/1926 | Peirce, Jr. | 248/300 |
| 1,656,009 | 1/1928 | McMullin | 361/422 |
| 3,109,124 | 10/1963 | Sinninger | 361/423 |
| 3,363,145 | 1/1968 | Watanabe | 361/423 |

FOREIGN PATENT DOCUMENTS

| | | | |
|---|---|---|---|
| 127595 | 5/1948 | Australia | 361/423 |
| 1465770 | 5/1969 | Fed. Rep. of Germany | 339/154 A |

*Primary Examiner*—Neil Abrams

*Attorney, Agent, or Firm*—Christensen, O'Connor, Johnson & Kindness

[57] ABSTRACT

An offset adapter connector for use with a plug-in device, such as the line (L) relay of an originating register, that allows connections to be made to the terminals of the device and to the terminals of the socket into which the device is normally plugged is disclosed. The offset adapter connector includes an elongate housing having mounted therein, in axially offset positions, a plug and a socket. The connector plug fits into the socket into which the plug-in device is normally plugged and the plug-in device fits into the connector socket. Due to the side-by-side position of the connector plug andsocket, the plug-in device is offset from its normal position. While offset, the plug-in device retains its normal orientation, (e.g., vertical). As necessary, the connector plug and socket are wired together and to a cable suitable for making connections to related electronic circuitry.

6 Claims, 4 Drawing Figures

OFFSET ADAPTER CONNECTOR

BACKGROUND OF THE INVENTION

This invention is directed to connectors and, more particularly, to connectors suitable for making connections to the terminals of plug-in devices and the sockets into which such devices are normally plugged.

In certain environments it is necessary to make connections to the terminals of plug-in devices, such as tubes or relays, and the sockets into which such devices are normally plugged. For example, in order to convert an originating register, such as the #5 Crossbar Originating Register of a Telephone Central Office, into a form suitable for receiving information in DTMF (dual tone multifrequency) form, as well as rotary dial form, in a manner that does not interfere with the normal operation of the originating register or related test circuitry, it is necessary to make contact with the terminals of the line (L) relay of the originating register and its socket. As will be readily understood by those familiar with this and other originating registers, the L-relay is the relay that controls dial pulse counting. More specifically, as more fully described in a companion patent application Ser. No. 848,823, entitled "Solid State Pulsing Circuit for Pulsing Selected Line Relay Contacts" by Ray Ma, filed concurrently herewith on Nov. 7, 1977, in the #5 Crossbar Originating Register, it is necessary to connect the outputs of a pulsing circuit directly to selected terminals of the L-relay and to selected terminals of the L-relay socket in a series/parallel manner. The pulsing circuit is actuated by the output of a DTMF receiver (tone-to-pulse converter) and the selected connections are those that operate the dial pulse counting system of the originating register, specifically the pulse counter and the register advance relay. Selected connections (as opposed to connections to all terminals) are necessary in order for the originating register to be operated in a manner that does not disrupt the operation of related test equipment and in a manner that does not create any undesirable audio signals on the related telephone line.

In order for the required serial/parallel connections to be made to only selected terminals of the L-relay and its socket, it is desirable to insert an adapter connector between the L-relay and its socket. One proposed connector is "donut" shaped. One side of the connector comprises a connector plug adapted to fit into the L-relay socket. The other side of the connector comprises a connector socket suitable for receiving an L-relay. The connector plug and socket are axially aligned. The problem with this connector is that it "raises" the L-relay from the L-relay socket by an unacceptable amount. More specifically, a donut connector, while allowing the proper connections to be made to the terminals of an L-relay and its socket "raises" the L-relay by an amount that prevents it from being inserted into the donut connector after the donut connector is inserted into the L-relay socket in at least some originating registers, such as a #5 Crossbar Originating Register. The insertion difficulty is caused by equipment mounted in the frame of the #5 Crossbar Originating Register above the L-relay.

Tilting the L-relay outward sufficiently to provide the necessary clearance for the insertion of the L-relay is also an unacceptable solution because the L-relay must be oriented substantially vertically in order for it to operate satisfactorily. (In this regard, it is pointed out that an L-relay is a mercury relay.)

Therefore, it is an object of this invention to provide an adapter connector suitable for connecting a plug-in device, such as an L-relay, to its socket in a manner that allows external connections to be made to selected terminals of the plug-in device and its socket.

It is a further object of this invention to provide an offset adapter connector.

It is another object of this invention to provide an adapter connector suitable for allowing connections to be made to selected terminals of a plug-in device, such as an L-relay, and its socket, in a manner that does not change the orientation of the plug-in device.

SUMMARY OF THE INVENTION

In accordance with this invention, an offset adapter connector for use with a plug-in device such as the line (L)-relay of an originating register, is provided. The offset adapter connector allows series/parallel connections to be made to selected contacts of the plug-in device and its socket. The offset adapter connector comprises an elongate housing having mounted therein, in axially offset positions, a plug and a socket. The connector plug fits into the socket into which the plug-in device is normally plugged and the connector socket receives the plug-in device. When the plug of the offset adapter connector is mounted in the socket into which the plug-in device is normally plugged and the plug-in device is mounted in the socket of the offset adapter connector, theplug-in device is offset from its normal position. Because the connector plug and socket are side-by-side mounted, while offset, the plug-in device retains its normal orientation. Thus, if the plug-in device was previously vertical, it is still vertical. However, the offset does move the plug-in device away from components that surround its normal position. As a result, the plug-in device can be readily plugged into the socket of the offset adapted connector after the offset adapter connector is plugged into the plug-in device socket. The plug and socket wiring of the offset adapter connector are adapted to make connections to related electronic circuitry, such as a pulsing circuit adapted to ground and open circuit selected terminals of the plug-in device and its socket in a manner similar to the way such terminals would be open circuited and grounded if the plug-in device were operated in its normal fashion.

It will be appreciated from the foregoing summary that the offset adapter connector of the invention is an uncomplicated connector that offsets a plug-in device, such as an L-relay, in a manner that: maintains the orientation of the device; allows series/parallel connections to the terminals of the device, and its socket; and, allows the device to be plugged in without undue difficulty.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
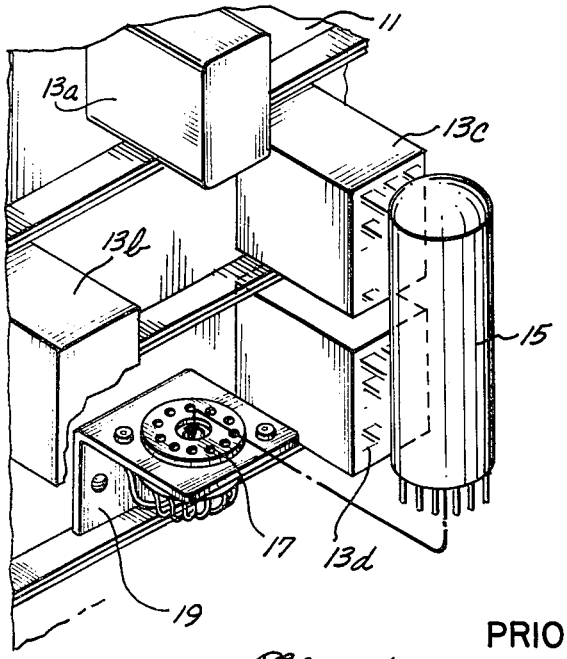
Fig. 1. PRIOR ART
FIG. 1 is a perspective view of a portion of an originating register frame illustrating the normal mounting of an L-relay in its socket.
Figure 2:
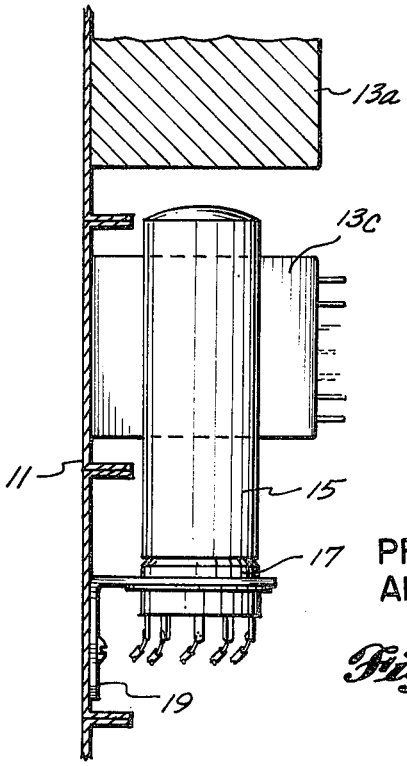
PRIOR ART Fig. 2.
FIG. 2 is a cross-sectional, elevational view of FIG. 1 showing the L-relay in its socket.

FIGS. 1 and 2 are generally directed to illustrating the problems solved by the present invention. That is, the present invention provides an adapter connector suitable for mounting a plug-in device, such as an L-relay, in an offset position such that the device remains functionally operable (because its orientation is not changed). The connector provides a mechanism though which connections can be made to the plug-in device and its socket.

FIG. 1 illustrates a portion 11 of the frame of a #5 Crossbar Originating Register. Mounted on the frame 11, in various positions, are a plurality of electronic components 13*a*, 13*b*, 13*c* and 13*d*, which could be capacitors, relays, terminal blocks, or other components well known to those familiar with originating registers. The electronic components 13*a*, 13*b*, 13*c* and 13*d* are mounted relatively close to one another about a space within which an L-relay 15 is normally mounted. Thus, the L-relay space is limited. The size limitations is such that, in certain cases, the L-relay cannot be raised above its socket 17 by much more that the amount needed to remove or install the L-relay.

The L-relay socket 17 is mounted in an L-shaped bracket 19. The L-shaped bracket 19 includes a vertical leg that is attached to a vertical surface of a row of the frame 11 of the originating register, between a pair of electronic components. The other leg of the L-shaped bracket 19 is horizontal. Mounted in the horizontal leg is the L-relay socket 17. As a result, the L-relay is vertically mounted. The L-relay is sized such that when plugged in, the top of the L-relay may be located slightly below a component 13*a* located two rows above the row in which the L-shaped bracket is mounted. Located in the row immediately above the row in which the L-shaped bracket 19 is mounted are two components 13*b* and 13*c*, one located on either side of the L-relay 15. As a result, as noted above, very little space exists for the insertion and removal of the L-relay.

As better described in the companion patent application entitled "Solid State Pulsing Circuit For Pulsing Selected Line Relay Contacts" by Ray Ma, referenced above, and incorporated herein by reference, in order for a DTMF receiver (tone-to-pulse converter) to be connected to some originating registers, such as a #5 Crossbar Originating Register, in a manner that allows the originating register to respond to information in both DTMF and rotary dial form, and in a manner that does not affect the operation of the originating register in an undesirable way or create undesired audio signals on connected tip and ring conductors, it is necessary to make serial/parallel connections to selected terminals of the L-relay and the L-relay socket. The selected terminals are those connected to the relay contacts normally connected to the pulse counter and to the register advance relay. In order for these connections to be made, it is necessary to mount an adapter connector between the L-relay 15 and the L-relay socket 17. Clearly, an adapter connector that is insertable between the L-relay socket 17 and the L-relay 15, which significantly raises the L-relay 15, cannot be used because the L-relay 15 could not be plugged into such an adapter connector after the adapter connector is mounted in the L-relay socket 17. Further, because the L-relay is a mercury relay, it cannot be mounted in a tilted position. The present invention, as illustrated in FIGS. 3 and 4, provides an offset adapter connector 21 that allows the desired connections to be made, maintains the L-relay vertical and allows it to be plugged in after the adapter connector is plugged into the L-relay socket (or plugged into the adapter connector prior to the adapter connector being plugged into the L-relay socket).

Figure 3:
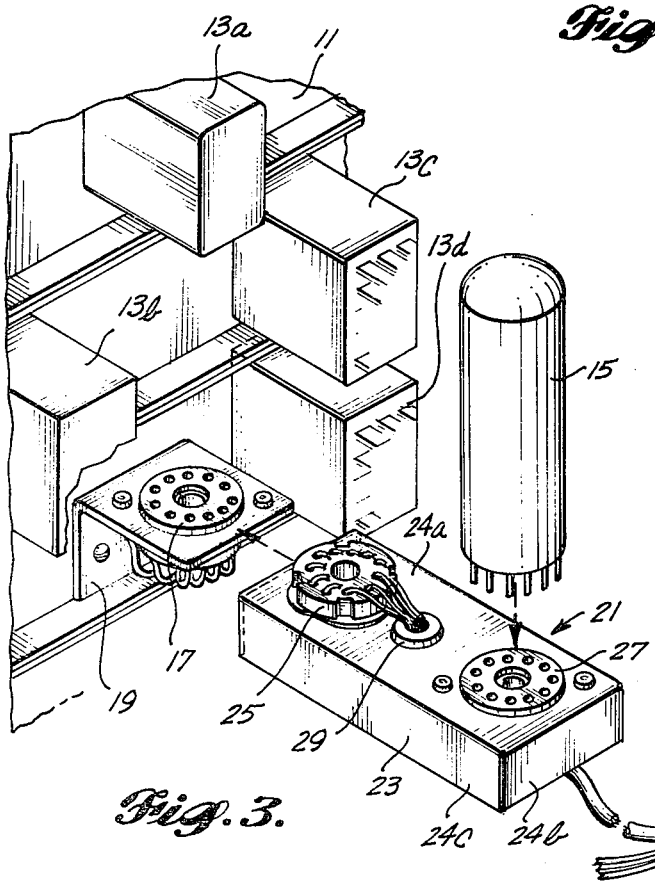
FIG. 3 is a perspective view illustrating an offset adapter connector formed in accordance with the invention and its use in an originating register of the type illustrated in FIG. 1 to mount an L-relay in an offset position that does not change the orientation of the L-relay; and, FIG. 4 is a cross-sectional, elevational view, partially in section, showing an L-relay mounted in an offset adapter connector formed in accordance with the invention and the offset adapter connector mounted in the L-relay socket of an originating register.
Figure 4:
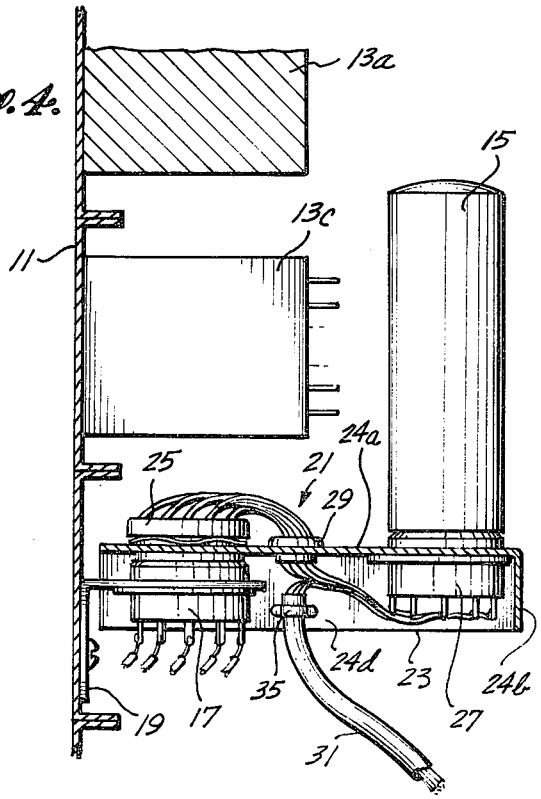

The embodiment of the offset adapter connector 21 of the invention illustrated in FIGS. 3 and 4 comprises a housing 23 that is generally box shaped and has an open bottom and an open end. Thus, the housing includes a top 24*a*, an end wall 24*b*, and two sidewalls 24*c* and 24*d*. Mounted in the top 24*a* of the housing 23, near the open end therof, is a plug 25. Mounted in the top of the housing 23 near the closed end thereof is a socket 27. Thus, the plug 25 and the socket 27 of the offset adapter connector are mounted in side-by-side positions. The prongs of the plug 25 project outwardly from the top into the housing and the prong receiving apertures of the socket 27 receive the L-relay prongs from the opposite direction, i.e., from the exterior of said housing. Thus, the prongs of the plug project outwardly from one face of the top and the socket receives the L-relay prongs from the other face. Also located in the top 24*a* of the housing 23 between the plug 25 and the socket 27 is an aperture in which a semiresilient, (e.g., rubber) grommet 29 is mounted.

A cable 31 having a connector 33 located at its outer end is mechanically attached by a strap 35 to one sidewall 24*d* of the frame 21. Conductors from the cable extend to selected terminals of the socket 27 and to selected terminals of the plug 25 of the offset adapter connector 21. In addition, wires run between selected terminals of the socket 27 and selected terminals of the plug 25. As necessary, the wires run between the connector plug and socket through the grommet 29. For a more detailed discussion of these connections, reference is made to the companion patent application referenced above and incorporated herein by reference. The connector plug 25 is sized such that it can be plugged into the L-relay socket 17. Similarly, the connector socket 27 is sized such that it can receive the prongs of the L-relay 15.

The sidewalls 24*c* and 24*d* of the housing 23 are positioned such that when the connector plug 25 is plugged into the L-relay socket 17, the sidewalls lie on either side of the horizontal leg of the L-shaped bracket 19. Further, the offset adapter connector projects orthogonally outwardly from the plane of the originating register frame 11. If the plugs and sockets are "keyed" together, the key and keyway are aligned when the offset adapter connector is in the foregoing position.

It will be appreciated from the foregoing description that the invention provides an offset adapter connector suitable for use in mounting an L-relay in an offset position with respect to its normal position in the frame of an originating register. While offset, the orientation of the L-relay is maintained, whereby the operation of the relay is not inhibited. The offset adapter connector allows connections to be made to any or all of the relay contacts or windings in a serial/parallel manner. The offset adapter connector is stable, whereby an L-relay can be readily plugged in or removed, as necessary. Because the L-relay is offset outwardly, surrounding components do not inhibit or prevent the insertion or removal of the L-relay.

While a preferred embodiment of the invention has been illustrated and described, it will be appreciated that various changes can be made therein without departing from the spirit and scope of the invention. Moreover, it will be appreciated that while the invention was designed for use, and has been described, in an originating register environment to allow connections to be made to terminals of an L-relay and its socket, the invention is useful in other environments to accomplish generally the same result. In this regard, the housing could comprise a simple flat plate; or a substantially entirely enclosed box; or a box with angle support brackets. Further, while the plug and socket have been illustrated as mounted in axially offset, side-by-side positions, they could be "stepped" with respect to one another, yet still be axially offset. In such a case, the housing would be stepped. Further, since a mercury relay can be tilted by a limited amount (up to 30° from the vertical in some cases) the axis of the socket may be titled slightly with respect to the vertical axis of the plug; the axes remains offset in the housing or support member. Hence, the invention can be practiced otherwise than as specifically described herein.

The embodiments of the invention in which an exclusive property or privilege is claimed are defined as follows:

1. An offset adapter connector suitable for insertion between a plug-in device and the socket into which said plug-in device is normally plugged, said offset adapter connector comprising:

a housing including a main wall and a pair of parallel sidewalls projecting transversely outwardly from said main wall;

a plug mounted in said main wall of said housing such that the prongs of said plug project outwardly from said main wall so as to lie inside said housing, between said sidewalls of said housing;

a socket mounted in said main wall of said housing so as to be offset from said plug and such that the prong receiving apertures of said socket receive the prongs of a plug-in device from a direction opposite to the direction in which said prongs of said plug project;

an aperture in said main wall between said plug and said socket;

internal connecting means for selectively connecting said prongs of said plug to said prong receiving apertures of said socket comprising a plurality of wires passing through said aperture; and, external circuit connecting means for making connections to electronic circuitry connected to selected ones of said prongs of said plug and to selected ones of said prong receiving apertures of said socket.

2. An offset adapter connector as claimed in claim 1 wherein said external circuit connecting means comprises: a cable including a plurality of wires, one end of said wires connected to selected ones of said prongs of said plug and to selected ones of said prong receiving apertures of said socket; and, a connector connected to the other ends of said wires.

3. An offset adapter connector as claimed in claim 2 including a semiresilient grommet mounted in said aperture about said plurality of wires.

4. In telephone equipment, such as an originating register, comprising a frame on which a plurality of electronic components are mounted, said plurality of electronic components including a horizontal L-relay socket, mounted in a bracket, adapted to receive an L-relay and an L-relay normally mounted in said horizontal L-relay socket, the improvement comprising an offset adapter connector mounted between said L-relay and said horizontal L-relay socket, said offset adapter connector comprising:

a housing including a top wall and a pair of parallel sidewalls projecting downwardly from said top wall;

a plug mounted in said top wall of said housing such that the prongs of said plug project downwardly from said top wall into said horizontal L-relay socket, and such that the sidewalls of said housing lie alongside of the bracket in which said horizontal L-relay socket is mounted;

a socket, for receiving said L-relay, mounted in said top wall of said housing so as to be axially offset from said plug and such that the prong-receiving apertures of said socket receive the prongs of said L-relay from above;

an aperture in said top wall between said plug and said socket;

internal connecting means for selectively connecting said prongs of said plug to said prong receiving apertures of said socket comprising a plurality of wires passing through said aperture; and, external circuit connecting means for connecting a pulsing circuit to selected ones of said prongs of said plug and to selected ones of said prong receiving apertures of said socket.

5. The improvement claimed in claim 4 wherein said external circuit connecting means comprises:

a cable including a plurality of wires, one end of said wires connected to selected ones of said prongs of said plug and to selected ones of said prong receiving apertures of said socket; and a connector connected to the other ends of said wires.

6. The improvement claimed in claim 5 including a semiresilient grommet mounted in said aperture about said plurality of wires.

* * * * *